US010888919B2

(12) United States Patent
Okumura et al.

(10) Patent No.: US 10,888,919 B2
(45) Date of Patent: Jan. 12, 2021

(54) CORE FORMING DEVICE AND CORE FORMING METHOD

(71) Applicants: TOYOTA JIDOSHA KABUSHIKI KAISHA, Toyota (JP); Sintokogio, Ltd., Nagoya (JP)

(72) Inventors: Katsutoshi Okumura, Toyota (JP); Hirotsune Watanabe, Miyoshi (JP); Shogo Izumi, Toyota (JP); Hirotaka Kurita, Toyokawa (JP); Katsushige Yamamoto, Toyokawa (JP)

(73) Assignees: TOYOTA JIDOSHA KABUSHIKI KAISHA, Toyota (JP); Sintokogio, Ltd., Nagoya (JP)

( * ) Notice: Subject to any disclaimer, the term of this patent is extended or adjusted under 35 U.S.C. 154(b) by 0 days.

(21) Appl. No.: 16/345,137

(22) PCT Filed: Oct. 13, 2017

(86) PCT No.: PCT/IB2017/001338
§ 371 (c)(1),
(2) Date: Apr. 25, 2019

(87) PCT Pub. No.: WO2018/078437
PCT Pub. Date: May 3, 2018

(65) Prior Publication Data

US 2019/0283119 A1 Sep. 19, 2019

(30) Foreign Application Priority Data

Oct. 31, 2016 (JP) ..... 2016-213525

(51) Int. Cl.
*B22C 13/16* (2006.01)
*B22C 15/02* (2006.01)
(Continued)

(52) U.S. Cl.
CPC ..... *B22C 13/16* (2013.01); *B22C 5/044* (2013.01); *B22C 5/0472* (2013.01); *B22C 9/10* (2013.01); *B22C 15/02* (2013.01); *B22C 15/08* (2013.01)

(58) Field of Classification Search
CPC ..... B22C 13/16; B22C 15/02; B22C 15/08; B22C 9/10
See application file for complete search history.

(56) References Cited

U.S. PATENT DOCUMENTS

2006/0071364 A1* 4/2006 Zenpo ..... B22C 15/23 264/219
2015/0197044 A1 7/2015 Kato et al.
2016/0052047 A1 2/2016 Uchida et al.

FOREIGN PATENT DOCUMENTS

CN 104395012 A 3/2015
EP 2 865 460 A1 4/2015
(Continued)

OTHER PUBLICATIONS

International Search Report dated Feb. 7, 2018 in PCT/IB2017/001338 filed Oct. 13, 2017.

*Primary Examiner* — Kevin E Yoon
(74) *Attorney, Agent, or Firm* — Oblon, McClelland, Maier & Neustadt, L.L.P.

(57) ABSTRACT

A core forming device is equipped with a kneading tank in which raw materials of a core are kneaded, a raw material supply unit that supplies the raw materials to the kneading tank, a mold that accommodates a kneaded material including the raw materials kneaded in the kneading tank and that forms the core, a piston that injects the kneaded material into the mold, a position sensor that detects a position of the piston, and a control unit that controls a supply amount of the raw materials supplied to the kneading tank from the raw material supply unit. The control unit determines the supply
(Continued)

amount of the raw materials based on a difference between the position of the piston upon completion of injection and a reference position of the piston.

7 Claims, 9 Drawing Sheets

(51) Int. Cl.

| | |
|---|---|
| ***B22C 15/08*** | (2006.01) |
| ***B22C 5/04*** | (2006.01) |
| ***B22C 9/10*** | (2006.01) |

(56) References Cited

FOREIGN PATENT DOCUMENTS

| | | | |
|---|---|---|---|
| FR | 2 625 939 | A1 | 7/1989 |
| JP | 5-212490 | A | 8/1993 |
| JP | 10-34282 | A | 2/1998 |
| JP | 2014-184477 | A | 10/2014 |

* cited by examiner

CORE FORMING DEVICE AND CORE FORMING METHOD

BACKGROUND OF THE INVENTION

1. Field of the Invention

The invention relates to a core forming device and a core forming method for forming a core for casting.

2. Description of Related Art

As disclosed in, for example, Japanese Patent Application Publication No. 2014-184477 (JP 2014-184477 A), with a core forming device for forming a core for casting in general, raw materials of the core are kneaded in a kneading tank, and a kneaded material thus obtained is injected into a mold by a piston to form the core.

SUMMARY OF THE INVENTION

The inventors have found the following problem regarding the core forming device. FIG. 8 is a partial cross-sectional view of a core forming device according to the related art. FIG. 8 shows a state where injection is completed by injecting a kneaded material S2 kneaded in a kneading tank 20 into a mold 70 by a piston 50. It should be noted herein that the mold 70 is constituted of, for example, an upper mold 71 and a lower mold 72, and that a cavity 73 is formed between the upper mold 71 and the lower mold 72, as shown in FIG. 8. The piston 50 is advanced (moved in a negative direction along a z-axis shown in FIG. 8) by a cylinder 60, so the interior of the cavity 73 is filled with the kneaded material S2 injected from the kneading tank 20. As a result, the core is formed.

With the core forming device shown in FIG. 8, the same mass of the raw materials is supplied every time injection is carried out, and the core is repeatedly formed. Therefore, the position of the piston 50 upon completion of injection should ideally be the same every time injection is carried out. However, the position of the piston 50 upon completion of injection actually disperses every time injection is carried out, due to various factors, for example, the leakage of the kneaded material S2 from a gap created in the mold 70, and the like.

FIG. 9 is a graph showing how the mass and strength of the core change with respect to the position of the piston upon completion of injection. The axis of abscissa represents the position (mm) of the piston upon completion of injection, the axis of ordinate on the left side represents the mass (g) of the formed core, and the axis of ordinate on the right side represents the strength (N) of the formed core.

The position of the piston in FIG. 9 is equal to 0 mm when the piston 50 has most retreated (when the length of a cylinder rod 62 that is accommodated in a cylinder body 61 is maximized in FIG. 8). The value of the position of the piston increases as the piston 50 advances. Therefore, it is meant that the amount of the raw materials remaining in the kneading tank after injection increases as the value of the position of the piston upon completion of injection decreases, and that the amount of the raw materials remaining in the kneading tank after injection decreases as the value of the position of the piston upon completion of injection increases.

The inventors have found out that the mass and strength of the core change depending on the position of the piston upon completion of injection as shown in FIG. 9. That is, the core forming device shown in FIG. 8 has a problem in that the position of the piston 50 upon completion of injection disperses every time injection is carried out, and that the quality of the formed core also disperses every time injection is carried out.

The invention provides a core forming device and a core forming method that can restrain the quality of a formed core from dispersing.

In a first aspect of the invention, a core forming device is equipped with a kneading tank in which raw materials of a core are kneaded, a raw material supply unit that is configured to supply the raw materials to the kneading tank, a mold that is configured to accommodate a kneaded material including the raw materials kneaded in the kneading tank and form the core, a piston that is configured to inject the kneaded material in the kneading tank into the mold, a position sensor that is configured to detect a position of the piston, and a control unit that is configured to control a supply amount of the raw materials supplied to the kneading tank from the raw material supply unit. The control unit determines the supply amount of the raw materials based on a difference between the position of the piston detected by the position sensor upon completion of injection and a reference position of the piston determined in advance.

In the core forming device according to the first aspect of the invention, the control unit that is configured to control the supply amount of the raw materials supplied to the kneading tank from the raw material supply unit determines the supply amount of the raw materials based on the position of the piston detected by the position sensor upon completion of injection and the reference position of the piston determined in advance. That is, instead of supplying the same mass of the raw materials every time injection is carried out, the amount of the actually injected and kneaded material is calculated from the position of the piston upon completion of injection every time injection is carried out, and the supply amount of the raw materials is determined. Therefore, the position of the piston upon completion of injection is restrained from dispersing, and the quality of the formed core can also be restrained from dispersing.

In the first aspect of the invention, the core forming device may be further equipped with a cylinder that drives the piston, and the position sensor may be built in the cylinder. Owing to this configuration, the position sensor is excellent in durability.

In the first aspect of the invention, the position of the piston may be a position in a direction in which the kneaded material is injected.

In the first aspect of the invention, the control unit may determine a supply amount of the raw materials to be subsequently injected into the mold.

In the first aspect of the invention, the control unit may calculate an amount of the raw materials corresponding to the kneaded material injected into the mold based on a difference between the position of the piston detected by the position sensor upon completion of injection and a reference position of the piston determined in advance, and determine the supply amount of the raw materials.

In a second aspect of the invention, a core forming method includes supplying raw materials of a core to a kneading tank, kneading the raw materials in the kneading tank, injecting a kneaded material including the raw materials kneaded in the kneading tank into a mold by a piston and forming the core, and determining a supply amount of the raw materials supplied to the kneading tank, based on a difference between a position of the piston upon completion of injection and a reference position of the piston determined in advance.

In the second aspect of the invention, the supply amount of the raw materials supplied to the kneading tank is determined based on the difference between the position of the piston upon completion of injection and the reference position of the piston determined in advance. That is, instead of supplying the same mass of the raw materials every time injection is carried out, the amount of the actually injected and kneaded material is calculated from the position of the piston upon completion of injection every time injection is carried out, and the supply amount of the raw materials is determined. Therefore, the position of the piston upon completion of injection is restrained from dispersing, and the quality of the formed core can also be restrained from dispersing.

In the second aspect of the invention, the position of the piston may be a position in a direction in which the kneaded material is injected.

In the second aspect of the invention, a supply amount of the raw materials to be subsequently injected into the mold may be determined.

In the second aspect of the invention, an amount of the raw materials corresponding to the kneaded material injected into the mold may be calculated based on a difference between a position of the piston upon completion of injection and a reference position of the piston determined in advance, and the supply amount of the raw materials may be determined.

According to the invention, a core forming device and a core forming method that can restrain the quality of a formed core from dispersing can be provided.

BRIEF DESCRIPTION OF THE DRAWINGS

Features, advantages, and technical and industrial significance of an exemplary embodiment of the invention will be described below with reference to the accompanying drawings, in which like numerals denote like elements, and wherein.

DETAILED DESCRIPTION OF EMBODIMENT

The concrete embodiment to which the invention is applied will be described hereinafter in detail with reference to the drawings. It should be noted, however, that the invention is not limited to the following embodiment thereof. Besides, the following description and drawings are simplified as appropriate, for the sake of clarification of explanation.

(First Embodiment)

Figure 1:
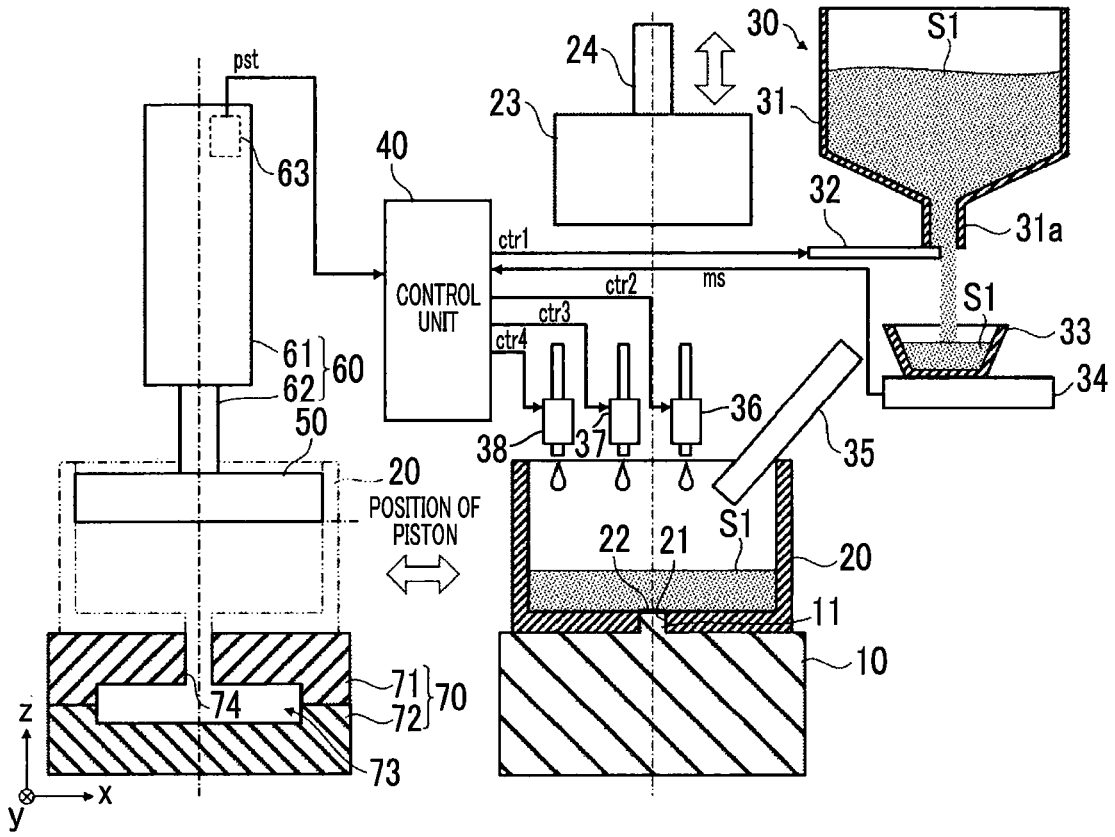
FIG. 1 is a general cross-sectional view of a core forming device according to the first embodiment of the invention.
Figure 2:
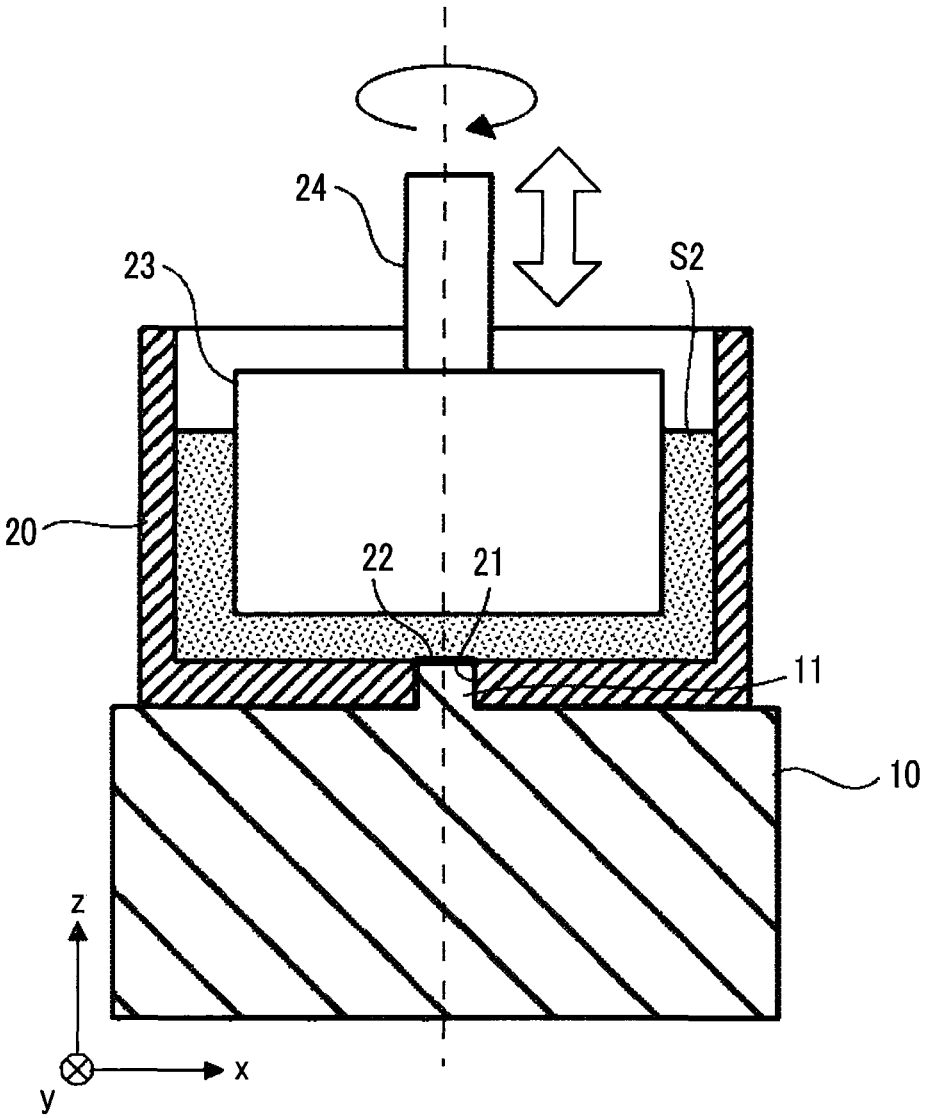
FIG. 2 is a partial cross-sectional view of the core forming device according to the first embodiment of the invention.
Figure 3:
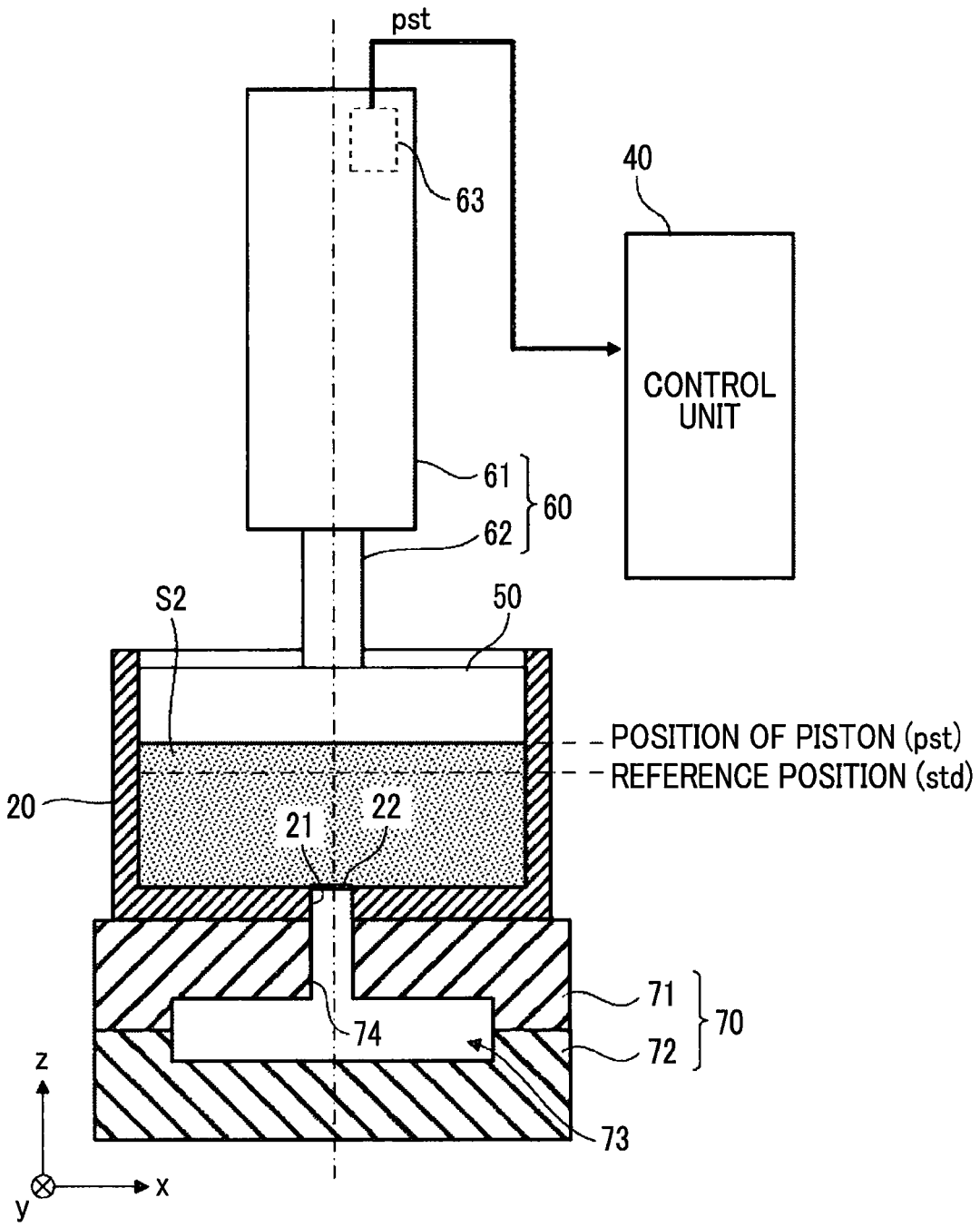
FIG. 3 is a partial cross-sectional view of the core forming device according to the first embodiment of the invention.
Figure 4:
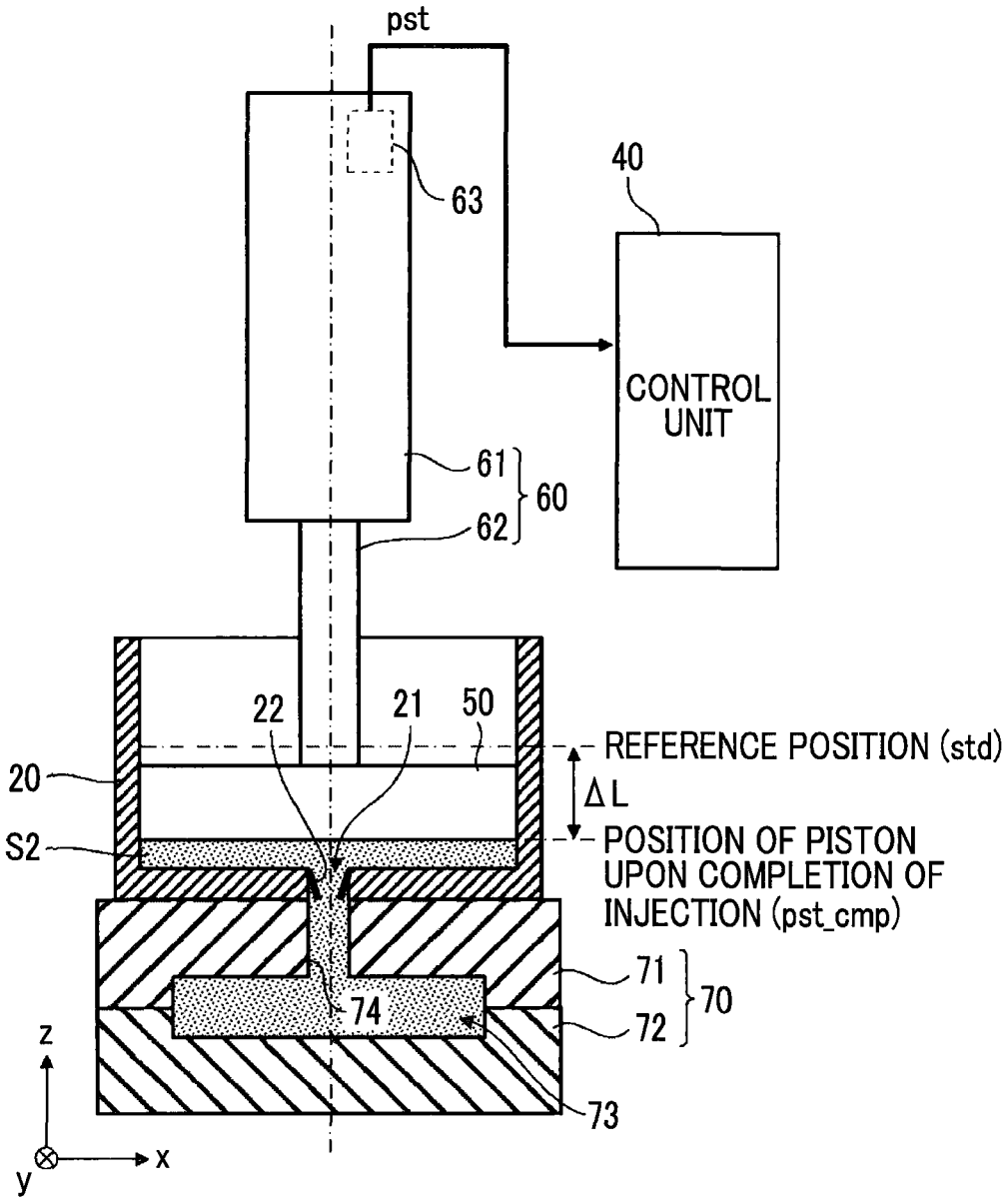
FIG. 4 is a partial cross-sectional view of the core forming device according to the first embodiment of the invention.

First of all, a core forming device according to the first embodiment of the invention will be described with reference to FIGS. 1 to 4. FIG. 1 is a general cross-sectional view of the core forming device according to the first embodiment of the invention. Each of FIGS. 2 to 4 is a partial cross-sectional view of the core forming device according to the first embodiment of the invention. As shown in FIG. 1, the core forming device according to the present embodiment of the invention is equipped with a pedestal 10, the kneading tank 20, a raw material supply unit 30, a control unit 40, the piston 50, the cylinder 60, and the mold 70. Incidentally, as a matter of course, a right-handed xyz-coordinate system shown in FIG. 1 and the other drawings is used for the sake of convenience to illustrate a positional relationship among components. In general, as is common among the drawings, a positive direction along a z-axis is a vertically upward direction, and an xy-plane is a horizontal plane.

The kneading tank 20 is a cylindrical member that is open at an upper portion thereof and that has a bottom portion. For example, the kneading tank 20 is dimensioned with an inner diameter of about 250 mm and a height of about 250 mm. As shown in FIG. 1, sand S1, water, water glass, a liquid additive such as a surfactant or the like, which constitute raw materials of a core, are supplied to the kneading tank 20 from the open upper portion thereof. Espearl (manufactured by Yamakawa Sangyo Co., Ltd.), Lunamos (manufactured by Kao Quaker Co., Ltd.), green beads (manufactured by Kinseimatec Co., Ltd.), AC alumina sand (manufactured by Hisagoya Co., Ltd.) and the like can be mentioned as concrete examples of the sand S1. Incidentally, water glass is a binder. The binder is not absolutely required to be water glass, but can be appropriately selected.

A through-hole 21 through which the kneaded material S2 (see FIGS. 2 to 4) kneaded inside the kneading tank 20 is injected is provided through the bottom portion of the kneading tank 20. For example, a rubbery valve 22 is attached to this through-hole 21. The raw materials such as the sand S1 and the like supplied to the kneading tank 20, and the kneaded material S2 produced after kneading can be restrained from leaking out of the kneading tank 20 by the valve 22. On the other hand, a central portion of the valve 22 is in the shape of, for example, a plus sign (+) in a plan view, and a vertically (in the direction of the z-axis) penetrating notch is provided therethrough. Therefore, as shown in FIG. 4, when the kneaded material S2 in the kneading tank 20 is pressurized and injected, the valve 22 can be opened by the notch.

As shown in FIG. 1, the kneading tank 20 is placed on, for example, the pedestal 10 having a horizontal upper surface. A convex portion 11 that is fitted through the through-hole 21 that is provided through the bottom portion of the kneading tank 20 is formed on the upper surface of the pedestal 10. That is, the convex portion 11 of the pedestal 10 is fitted through the through-hole 21 of the kneading tank 20, and supports, from below, the valve 22 that is attached to the through-hole 21. Owing to this configuration, even during kneading shown in, for example, FIG. 2, the kneaded material S2 can be restrained from leaking out of the kneading tank 20.

As shown in FIG. 2, the kneaded material S2 is obtained by kneading the raw materials such as the sand S1 and the like supplied to the kneading tank 20 by a kneading blade 23. The kneading blade 23 is constituted of a single or a plurality of plate-like members that are fixed to a rotary rod 24 that is extended in a vertical direction (the direction of the z-axis). The direction of a normal line of the single plate-like member constituting the kneading blade 23, or the directions of normal lines of the plurality of the plate-like members constituting the kneading blade 23 are perpendicular to the direction of the z-axis without exception. The rotary rod 24 is coupled to a drive source (not shown) such as a motor or the like, and the kneading blade 23 rotates around the rotary rod 24. It should be noted herein that a central axis of the rotary rod 24 and a central axis of the kneading tank 20 preferably coincide with each other.

Besides, as shown in FIGS. 1 and 2, the kneading blade 23 can move together with the rotary rod 24 in the vertical direction (the direction of the z-axis direction). FIG. 1 schematically shows a state where the kneading blade 23 has retreated upward (toward a plus side along the z-axis) and does not rotate. FIG. 2 shows a state where the kneading blade 23 has descended (has moved toward a minus side along the z-axis) to be inserted into the kneading tank 20 and rotates.

As shown in FIG. 1, the raw material supply unit 30 is equipped with a hopper 31, a shutter 32, a weighing dish 33, a weighing meter 34, a sand throwing chute 35, and pumps 36 to 38. The sand S1 to be supplied to the kneading tank 20 is stored in the hopper 31. The shutter 32, which can be opened and closed, is attached to an exhaust port 31*a* of the hopper 31, and can adjust the amount of the sand S1 dropped onto the weighing dish 33 from the exhaust port 31*a*. The opening/closing and opening degree of the shutter 32 are controlled by a control signal ctr1 that is output from the control unit 40.

The weighing dish 33 is placed on the weighing meter 34, and a mass of the sand S1 dropped onto the weighing dish 33 is measured. For example, a load cell is built in the weighing meter 34, and the mass measured by the weighing meter 34 is output to the control unit 40 as a mass signal ms in the form of an electric signal. That is, the control unit 40 generates the control signal ctr1 based on the mass signal ms, and performs feedback control of the opening/closing and opening degree of the shutter 32.

In concrete terms, the control unit 40 performs, for example, the following control. When the sand S1 starts being dropped onto the weighing dish 33, the control unit 40 outputs the control signal ctr1 for fully opening the shutter 32. After that, when the mass signal ms that is output from the weighing meter 34 approaches a supply amount determined by the control unit 40, the control unit 40 outputs the control signal ctr1 for reducing the opening degree of the shutter 32. Then, the mass signal ms that is output from the weighing meter 34 reaches the supply amount determined by the control unit 40, the control unit 40 outputs the control signal ctr1 for closing the shutter 32.

When the mass of the sand S1 dropped onto the weighing dish 33 reaches the supply amount determined by the control unit 40, the weighing dish 33, for example, is inclined around a y-axis, and the sand S1 on the weighing dish 33 is supplied to the kneading tank 20 via the sand throwing chute 35.

The pumps 36 to 38 are diaphragm pumps for supplying water, water glass, and the surfactant to the kneading tank 20 respectively. The amount of water supplied from the pump 36 is controlled by a control signal ctr2 that is output from the control unit 40. By the same token, the amount of water glass supplied from the pump 37 is controlled by a control signal ctr3 that is output from the control unit 40. By the same token, the amount of the surfactant supplied from the pump 38 is controlled by a control signal ctr4 that is output from the control unit 40. For example, the control signals ctr2 to ctr4 are pulse signals. Water, water glass, and the surfactant whose amounts correspond to the numbers of times of the outputting of the pulse signals are supplied from the pumps 36 to 38 respectively.

After the raw materials such as the sand S1 and the like are kneaded in the kneading tank 20 placed on the pedestal 10, the kneading tank 20 that accommodates the kneaded material S2 is transferred from the pedestal 10 onto the mold 70. In FIG. 1, the kneading tank 20 on the mold 70 is indicated by an alternate long and two short dashes line. FIGS. 3 and 4 show how the kneaded material S2 in the kneading tank 20 is injected into the mold 70 by the piston 50. In concrete terms, FIG. 3 shows a state where injection is started, and FIG. 4 shows a state where injection is completed.

As shown in FIGS. 3 and 4, the piston 50 can be moved in the vertical direction (the direction of the z-axis) by the cylinder 60. It should be noted herein that the piston 50 advances when moving downward in the vertical direction, and that the piston 50 retreats when moving upward in the vertical direction. As shown in FIG. 4, the kneaded material S2 in the kneading tank 20 is injected into the mold 70 through the advancement of the piston 50.

The cylinder 60 is constituted of the cylinder body 61 and the cylinder rod 62. The piston 50 is attached to a tip of the cylinder rod 62. Besides, a position sensor 63, for example, a linear encoder or the like is built in the cylinder 60. Therefore, a position signal pst indicating a position of the piston is output to the control unit 40 from the cylinder 60. The position sensor 63 is built in the cylinder 60, and hence is more excellent in durability than an external position sensor. It should be noted, however, that the position sensor 63 does not need to be built in the cylinder 60.

The control unit 40 determines a supply amount of the raw materials based on a difference $\Delta L$ between a position signal pst_cmp indicating a position of the piston 50 detected by the position sensor 63 upon completion of injection and a reference position std of the piston 50 determined in advance. The reference position std is stored in a storage unit (not shown) with which the control unit is equipped.

The reference position std can be obtained through, for example, an experiment. In concrete terms, for example, the reference position std is set to a certain value, and the position of the piston 50 upon completion of injection in actually forming the core is measured. Then, the value of the reference position std is corrected based on a deviation from a target position of the piston 50 upon completion of injection. The reference position std can be determined by carrying out this process at least once.

That is, with the core forming device according to the first embodiment of the invention, an amount of the raw materials corresponding to the actually injected and kneaded material S2 is calculated from the position of the piston 50 upon completion of injection, and the raw materials are supplied every time injection is carried out, instead of supplying the same mass of the raw materials every time injection is carried out. Therefore, the position of the piston 50 upon completion of injection is restrained from dispersing, and the quality of the formed core can also be restrained from dispersing.

Figure 5:
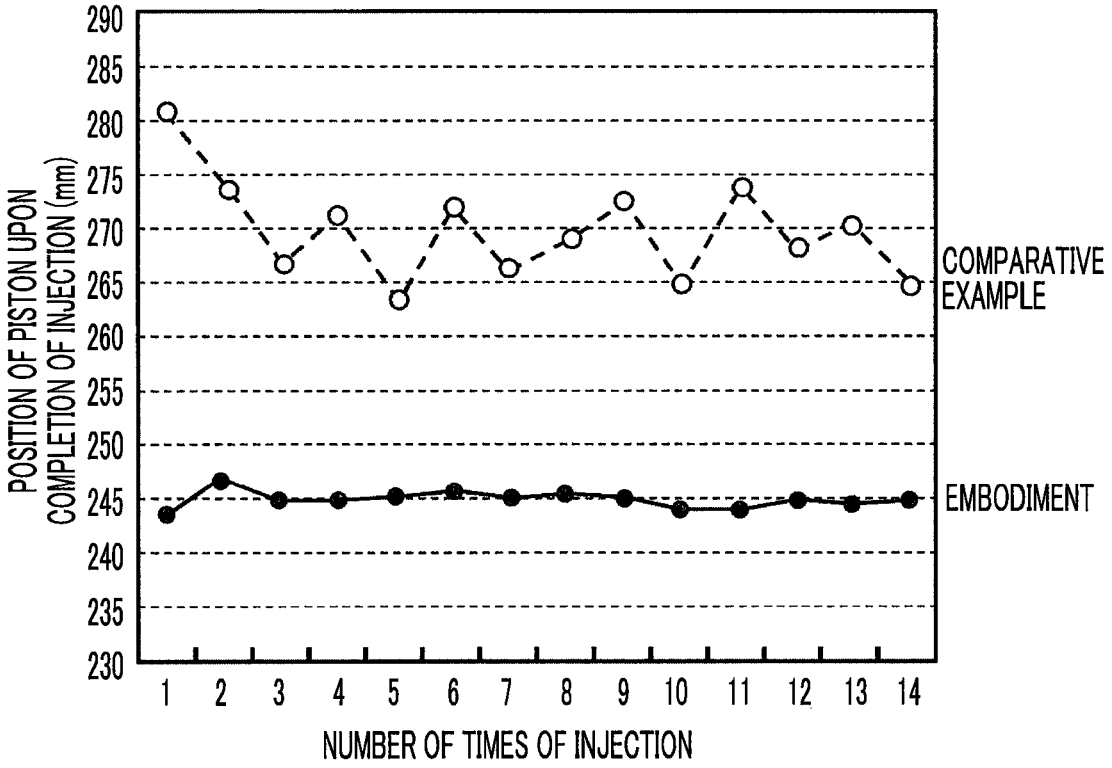
FIG. 5 is a graph showing the dispersion of the position of a piston upon completion of injection in the core forming device according to the first embodiment of the invention and a core forming device according to a comparative example.

An example of a concrete method of calculating a supply amount of the sand S1 (a sand supply amount), a supply amount of the binder, a supply amount of the surfactant, and a supply amount of water will be presented hereinafter. Incidentally, an equation shown below is nothing more than an example, and can be modified in various manners. First of all, an amount of the kneaded material S2 that is required (a required amount of the kneaded material) can be obtained from the aforementioned difference ΔL, in accordance with the equation shown below.

required amount of kneaded material=specific gravity of sand×ΔL×cross-sectional area of kneading tank Subsequently, the supply amount of the binder, the supply amount of the surfactant, and the supply amount of water can be obtained from this required amount of the kneaded material in accordance with equations shown below.

supply amount of sand=required amount of kneaded material×(1−addition rate of water)×(1−effective addition rate of binder−effective addition rate of surfactant)

supply amount of binder=required amount of kneaded material×effective addition rate of binder÷concentration of binder solution supply amount of surfactant=required amount of kneaded material×effective addition rate of surfactant÷concentration of surfactant solution supply amount of water=required amount of kneaded material×addition rate of water−supply amount of binder×(1−concentration of binder solution)−supply amount of surfactant×(1−concentration of surfactant solution)+exudation amount of water FIG. 5 is a graph showing the dispersion of the position of the piston upon completion of injection in the core forming device according to the first embodiment of the invention and a core forming device according to a comparative example. In the comparative example, the same mass of the raw materials is supplied every time injection is carried out. Therefore, the dispersion of the position of the piston 50 upon completion of injection has a width between about 263 mm and about 281 mm, namely, a width of about 18 mm. In contrast, according to the embodiment of the invention, an amount of the raw materials corresponding to the actually injected and kneaded material S2 is calculated from the position of the piston 50 upon completion of injection, and the raw materials are supplied every time injection is carried out. Therefore, the dispersion of the position of the piston 50 upon completion of injection is significantly improved to a width between about 243 mm and about 247 mm, namely, a width of about 4 mm.

Figure 6:
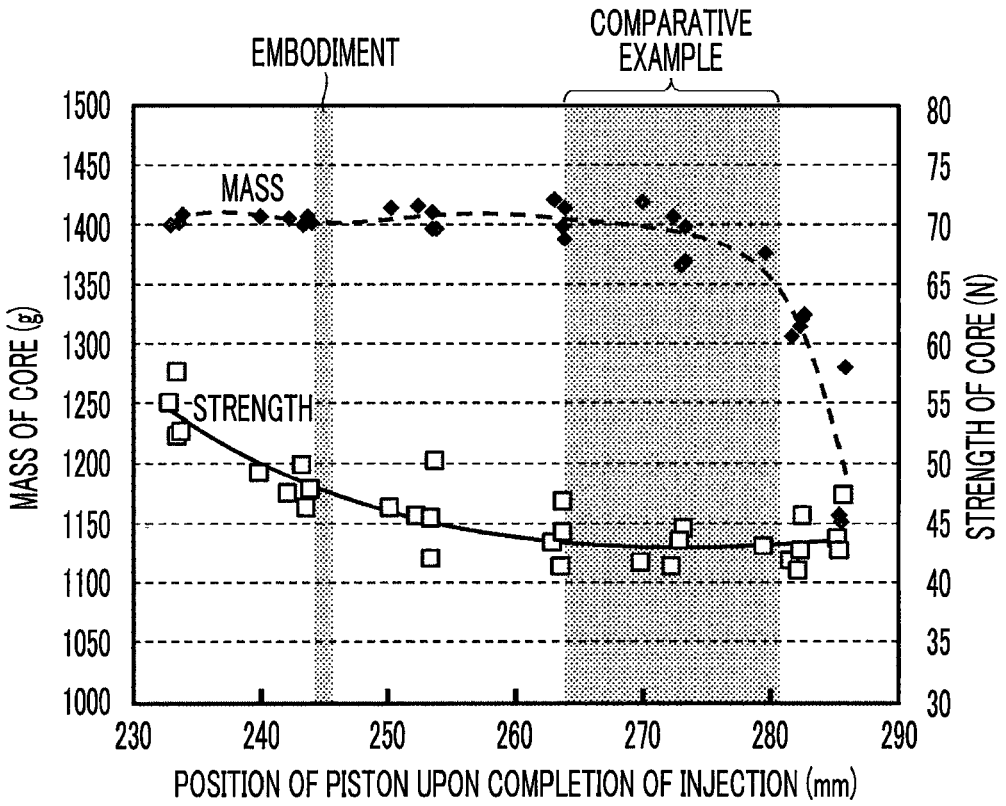
FIG. 6 is a graph showing how the mass and strength of a core change with respect to the position of the piston upon completion of injection.
Figure 9:
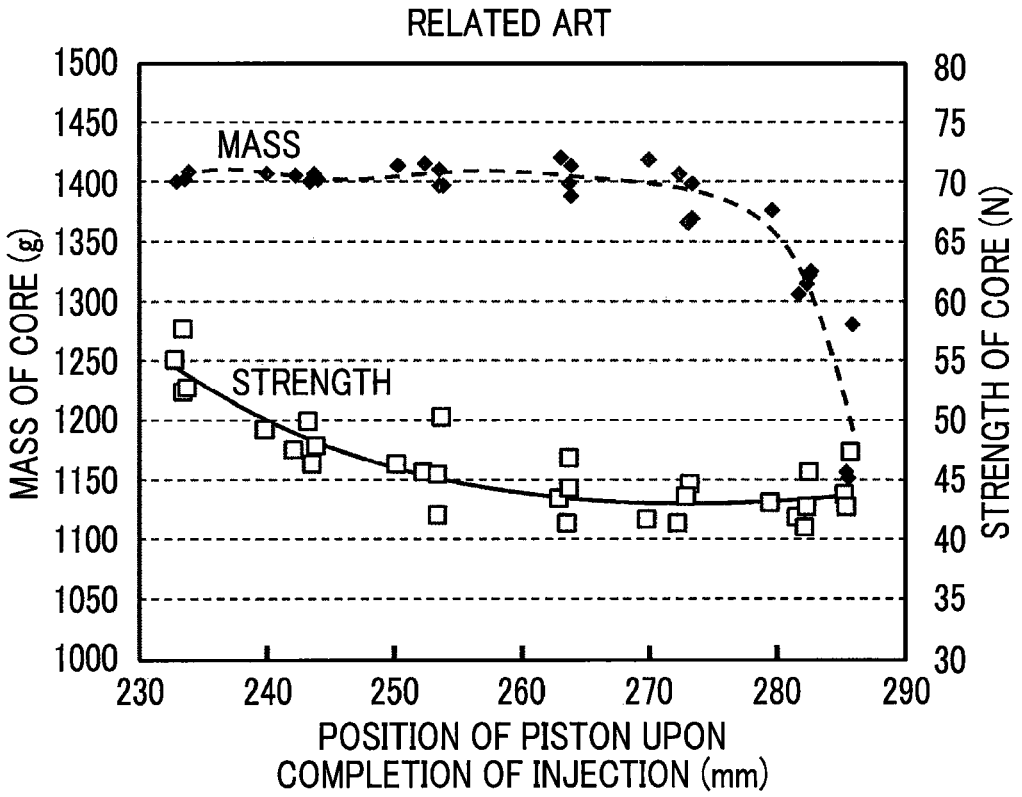
FIG. 9 is a graph showing how the mass and strength of a core change with respect to the position of a piston upon completion of injection.

FIG. 6 is a graph showing how the mass and strength of the core change with respect to the position of the piston upon completion of injection. In concrete terms, this graph shows the results of the widths of the dispersion in the embodiment of the invention and the comparative example as shown in FIG. 5 in such a manner as to be superimposed on the graph shown in FIG. 9. As shown in FIG. 6, the dispersion of the position of the piston 50 upon completion of injection can be more significantly reduced in the embodiment of the invention than in the comparative example. As a result, the high-strength core can be more stably formed in the embodiment of the invention than in the comparative example.

Figure 7:
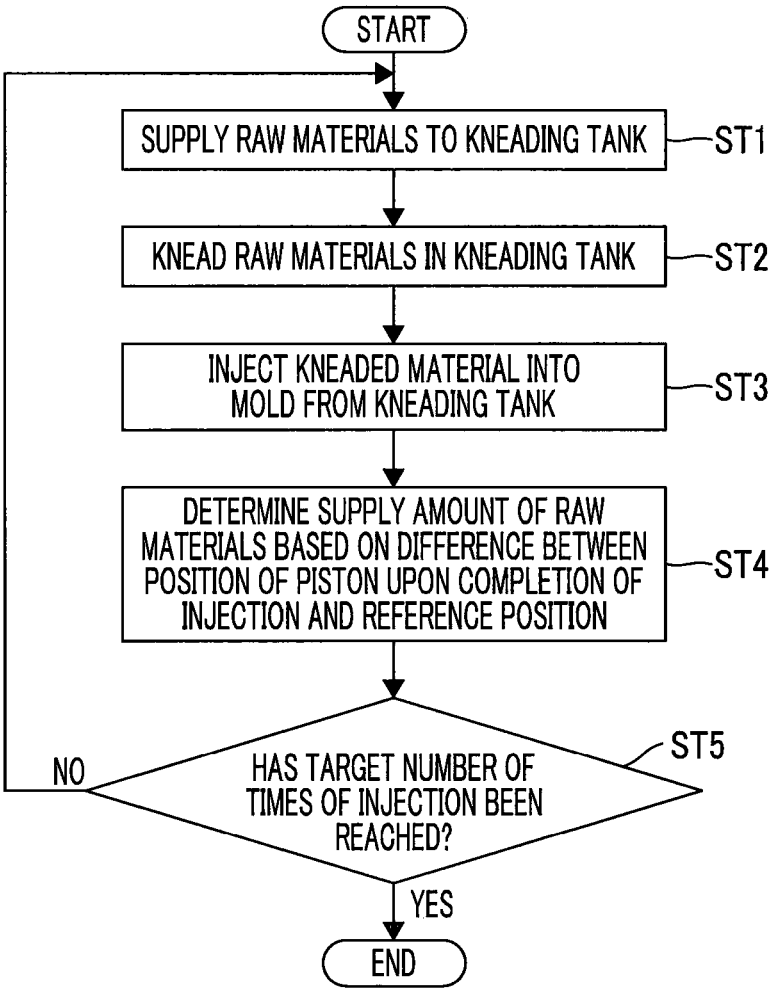
FIG. 7 is a flowchart showing a core forming method according to the first embodiment of the invention.
Figure 8:
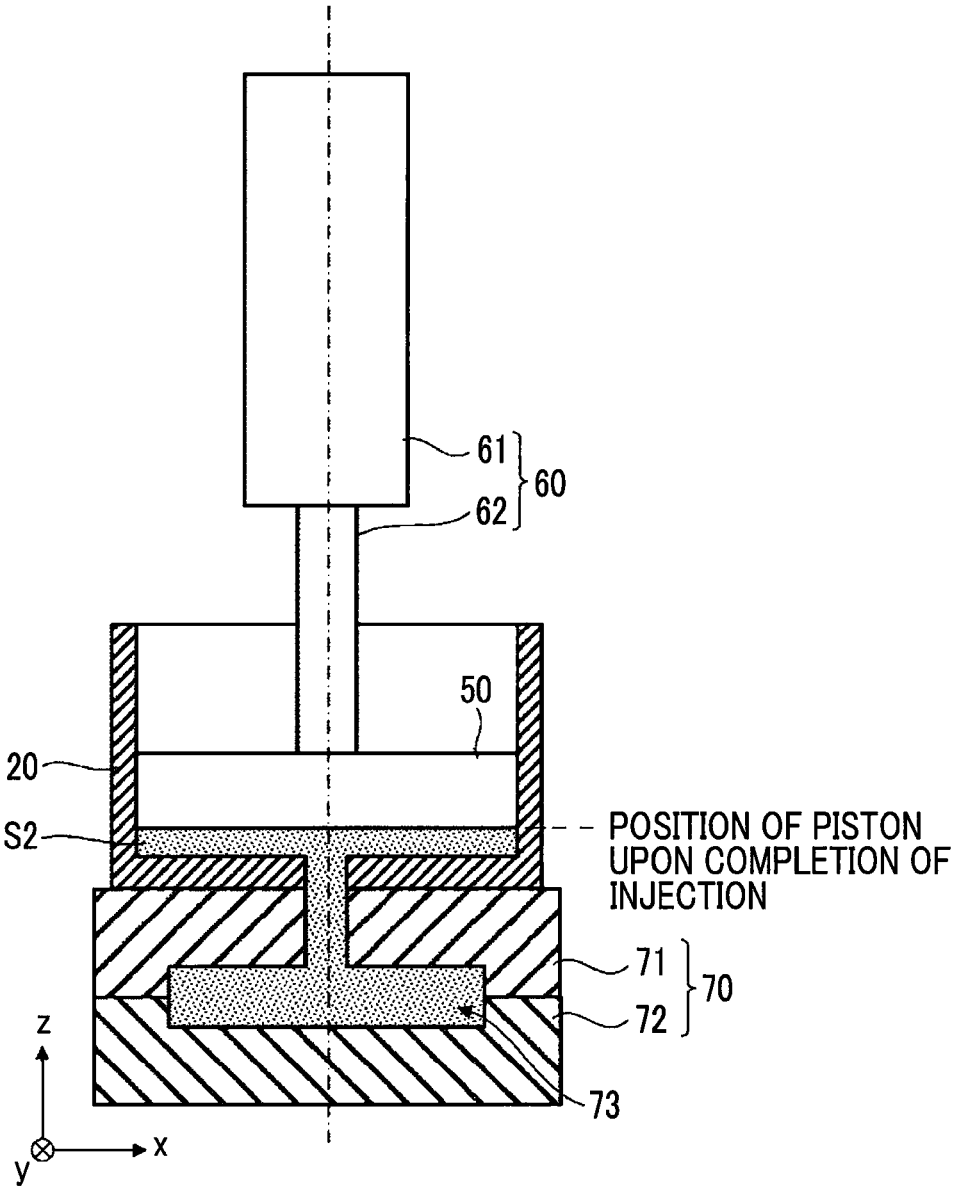
FIG. 8 RELATED ART
FIG. 8 is a partial cross-sectional view of a core forming device according to the related art.

Next, a core forming method according to the first embodiment of the invention will be described with reference to FIG. 7. FIG. 7 is a flowchart showing the core forming method according to the first embodiment of the invention. In describing FIG. 7, FIGS. 1 to 4 will be referred to as well. First of all, as shown in FIG. 1, the raw materials such as the sand S1, water, water glass, the surfactant and the like are supplied to the kneading tank 20 from the raw material supply unit 30 (step ST1). The mass of the raw materials supplied for the first time is larger than the mass of the formed core, and is, for example, twice to several times as large as the mass of the formed core.

Subsequently, as shown in FIG. 2, the raw materials are kneaded in the kneading tank 20 by the kneading blade 23 (step ST2). Subsequently, after the kneading tank 20 is transferred onto the mold 70, the kneaded material S2 in the kneading tank 20 is injected into the mold 70 by the piston 50 to form the core, as shown in FIGS. 3 and 4 (step ST3).

Subsequently, as shown in FIG. 4, the control unit 40 determines the supply amount of the raw materials based on the difference ΔL between the position signal pst_cmp indicating the position of the piston 50 detected by the position sensor 63 upon completion of injection and the reference position std of the piston 50 determined in advance (step ST4). Subsequently, if the target number of times of injection has not been reached (NO in step ST5), a return to step ST1 is made, and the supply amount of the raw materials determined in step ST4 is dropped into the kneading tank 20 in step ST4. On the other hand, if the target number of times of injection has been reached (YES in step ST5), the formation of the core is ended.

In the core forming method according to the first embodiment of the invention, the amount of the raw materials corresponding to the actually injected and kneaded material S2 is calculated from the position of the piston 50 upon completion of injection, and the calculated amount of the raw materials is supplied every time injection is carried out, instead of supplying the same mass of the raw materials every time injection is carried out. Therefore, the position of the piston 50 upon completion of injection is restrained from dispersing, and the quality of the formed core can also be restrained from dispersing.

Incidentally, the invention is not limited to the aforementioned embodiment thereof, but can be appropriately changed within such a range as not to depart from the gist thereof.

The invention claimed is:

1. A core forming device comprising:

a kneading tank in which raw materials of a core are kneaded;

a raw material supply unit that is configured to supply the raw materials to the kneading tank;

a mold that accommodates a kneaded material including the raw materials kneaded in the kneading tank, and that forms the core;

a piston that is configured to inject the kneaded material in the kneading tank into the mold;

a position sensor that is configured to detect a position of the piston; and a control unit that is configured to control a supply amount of the raw materials supplied to the kneading tank from the raw material supply unit, wherein the control unit determines the supply amount of the raw materials based on a difference between the position of the piston detected by the position sensor upon completion of injection and a reference position of the piston determined in advance, and the control unit calculates an amount of the raw materials corresponding to the kneaded material injected into the mold based on the difference between the position of the piston detected by the position sensor upon completion of injection and the reference position of the piston determined in advance, and determines the supply amount of the raw materials.

2. The core forming device according to claim 1, further comprising:

a cylinder that drives the piston, wherein the position sensor is built in the cylinder.

3. The core forming device according to claim 1, wherein the position of the piston is a position in a direction in which the kneaded material is injected.

4. The core forming device according to claim 1, wherein the control unit determines the supply amount of the raw materials to be subsequently injected into the mold.

5. A core forming method comprising:

supplying raw materials of a core to a kneading tank;

kneading the raw materials in the kneading tank;

injecting a kneaded material including the raw materials kneaded in the kneading tank into a mold by a piston, and forming the core; and determining a supply amount of the raw materials supplied to the kneading tank, based on a difference between a position of the piston upon completion of injection and a reference position of the piston determined in advance, wherein an amount of the raw materials corresponding to the kneaded material injected into the mold is calculated based on the difference between the position of the piston upon completion of injection and the reference position of the piston determined in advance, and the supply amount of the raw materials is determined.

6. The core forming method according to claim 5, wherein the position of the piston is a position in a direction in which the kneaded material is injected.

7. The core forming method according to claim 5, wherein a supply amount of the raw materials to be subsequently injected into the mold is determined.

* * * * *